US006863197B1

(12) United States Patent
Dirlam et al.

(10) Patent No.: US 6,863,197 B1
(45) Date of Patent: Mar. 8, 2005

(54) GARMENT HANGER WITH IMPROVED GARMENT SECURING GRIPS

(75) Inventors: Michael A. Dirlam, St. Joseph, MI (US); Michael L. Walker, Berrien Springs, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 10/346,031

(22) Filed: Jan. 16, 2003

(51) Int. Cl.[7] ..... A41D 27/22
(52) U.S. Cl. ..... 223/93
(58) Field of Search ..... 223/93; 248/587

(56) References Cited

U.S. PATENT DOCUMENTS 1,768,497 A * 6/1930 Willsea ..... 211/45
2,435,859 A 2/1948 Whitman ..... 223/91
2,488,709 A * 11/1949 Colwell ..... 24/498
6,474,517 B1 11/2002 Sutton ..... 223/96

* cited by examiner

*Primary Examiner*—John J. Calvert
*Assistant Examiner*—James G Smith
(74) *Attorney, Agent, or Firm*—Robert O. Rice; John F. Colligan; Stephen Krefman

(57) ABSTRACT

A garment hanger for use in a garment treatment device or garment storage container includes a hook, a bow and a pair of garment clamps. The garment clamps each include a cam-like clothes gripping arrangement in which a cam is pivotally mounted within a channel and further include a release arm for opening the clamp and a spring for bringing the cam into engagement onto the garment. The cam positively grips the garment, using a series of raised ribs having a incrementally decreasing spacing for graduated engagement of the garment. Opposite the cam within the channel, a high friction surface aids garment retention.

12 Claims, 4 Drawing Sheets

GARMENT HANGER WITH IMPROVED GARMENT SECURING GRIPS

BACKGROUND OF THE INVENTION

The present invention relates generally to garment hangers for use in a garment treatment apparatus or, more generally, for supporting garments in an enclosure.

A garment hanger may be used in a treatment apparatus of the type which is a freestanding or wall-mounted device. A garment hanger may also be used in a treatment apparatus of the type which may be a collapsible type for compact storage. The garment hanger, in either previous case, may be used before or after treatment for convenient storage of the garment within an enclosure, such as a closet. Optionally, a garment hanger may be solely for use for convenient storage.

A well known feature of garment hangers is a cross-member or bar bridging the shoulders of the hanger for supporting a skirt, trousers, shorts or other garment which may not conveniently be supported by the hanger shoulders. The bar may have mounted thereon a plurality of clamps or grips for securing these garments. One type of conventional clamp is a "pinch" clamp, as disclosed for example in U.S. Pat. No. 6,474,517 to Sutton, which describes a variety of clamp which has a clamp end having a pair of opposed clamp or jaw members between which a portion of the garment is secured, and a handle portion having a pair of spaced apart handles. A spring or other means for providing clamping force biases the jaw members towards each other to create the clamping force necessary to retain a garment between inner surfaces of the jaw members. Pinching the handles toward one another causes the jaw members to open to receive or release a garment. The jaw members may also include inner surfaces having gripping surfaces or friction surfaces for improving grip on clothing items disposed therein.

Another type of garment clamp for use on a hanger is a clamp which operates on the same principle as a self-actuating or self-locking brake. A generally U-shaped channel is provided for receiving a garment, the opening of which faces downwardly so that the garment may be placed therein using an upward motion and removed therefrom using an opposite, downward. A hinged cam-like structure is located within the U-channel which hingedly retracts or moves aside when a garment is placed within the U-channel. Once a garment is in place, it becomes captured or secured by the cam-like structure, which tends to secure the garment by binding it against an opposing wall of the U-channel.

An example of a cam-actuated clamp as previously described may be found in U.S. Pat. No. 2,898,024 to Jenson, in which a hinged cam is rotatable through a predetermined arc, engaging the garment placed between the cam and an opposing fixed wall, thereby holding the garment in place against the force of gravity. It may be understood that the hinged cam becomes more effective the larger or heavier the garment, inasmuch as the locking force placed on it becomes greater as downward force on the garment is increased.

A second example of a cam-actuated clamp may be seen in U.S. Pat. No. 2,435,859 to Whitman, in which a roller having an axle extending therethrough may be mounted on the garment clamp. The axle is offset from the center of the roller which causes the roller to behave in a cam-like fashion, that is, the exterior of the roller moves in an eccentric motion defining an arc. When a garment is placed within the U-shaped channel, the roller is momentarily displaced. When the garment is released by the user, the roller rotates into gripping engagement of the garment, both through the action of the garment and action of gravity on the roller.

A drawback of the foregoing devices is the lack of a graduated or stepped engagement of the garment by the clamp, which may result in an unacceptable grip on the garment by the clamp. In the present invention, an improved gripping and releasing arrangement provides for a secure engagement of the garment by the clamp. This graduated or stepped engagement is provided for by a specific arrangement of gripping ribs which vary over a range of height and distance from one another, in order to provide secure grip over a wide range of garment materials, weights and thicknesses.

A further drawback of the foregoing devices in a garment hanger is the lack of a convenient handle for releasing the cam's grip on the garment. Yet a further drawback of the foregoing devices in a garment hanger is the lack of use of a material in the clamp adequate to maintain a secure grip on the garment.

These and other objects, features, and advantages of the present invention will become apparent upon a reading of the detailed description and a review of the accompanying drawings. Specific embodiments of the present invention are described herein. The present invention is not intended to be limited to only these embodiments.

SUMMARY OF THE INVENTION

The invention relates to a garment hanger having a suspending hook, a bow having a pair of ends, and a garment clamp. The garment clamp includes a garment receiving channel having a pair of opposed faces. One of the opposed faces has a garment gripping surface material. The other opposed face includes a hingedly disposed cam member. The cam member has a plurality of gripping surfaces for gripping a garment. The gripping surfaces include a spaced series of raised ribs extending transversely on the cam member. The raised ribs have a varying height, the height varying from comparatively high to comparatively low progressively from the clamp exterior to the clamp interior.

In another aspect, the invention relates to a garment hanger having a suspending hook, a bow having a pair of ends, and a garment clamp. The garment clamp includes a garment receiving channel having a pair of opposed faces. One of the opposed faces has a garment gripping surface material. The other opposed face includes a hingedly disposed cam member having a release handle. The cam member also has a plurality of gripping surfaces for gripping a garment.

In another aspect, the invention relates to a garment hanger having a suspending hook, a bow having a pair of ends, and a garment clamp. The garment clamp includes a garment receiving channel having a pair of opposed faces. One of the opposed faces has a garment gripping surface material. The other opposed face includes a hingedly disposed cam member. The cam member has a plurality of gripping surfaces for gripping a garment. The gripping surfaces include a spaced series of raised ribs having square edges.

In another aspect, the invention relates to a garment hanger having a suspending hook, a bow having a pair of ends, and a garment clamp. The garment clamp includes a garment receiving channel having a pair of opposed faces. One of the opposed faces has a high friction garment gripping surface material. The other opposed face includes a hingedly disposed cam member. The cam member has a plurality of gripping surfaces for gripping a garment.

In another embodiment, the invention relates to a garment hanger having a suspending hook, a bow having a pair of ends, a garment support rod extending between the bow ends, and at least one clamp mounted on the support rods for hanging a garment thereform. The clamp includes a garment receiving channel having a pair of opposed faces. One of the opposed faces has a high friction garment gripping surface material. The other opposed face includes a pivotally disposed cam member having a cam face and a release arm. The cam face has a plurality of gripping surfaces for gripping a garment. The cam face is also pivotable by the release arm in an out of garment gripping engagement against the high friction garment gripping surface material.

In another embodiment, the invention relates to a garment hanger having a suspending hook, a bow centrally mounted on and extending from the suspending hook and having a pair of ends, a garment support rod extending between the bow ends, and a clamp mounted on the support rod at each of the bow ends for hanging a garment therefrom. The clamp includes a garment receiving channel having a pair of opposed faces. One of the opposed faces has a high friction garment gripping surface material. The other opposed face includes a pivotally disposed cam member having a cam face and a release arm. The cam face has a plurality of gripping surfaces for gripping a garment. The cam face is also pivotable by the release arm in an out of garment gripping engagement against the high friction garment gripping surface material. Changes and modifications may be made to the described embodiments and yet fall within the scope of the present invention.

DETAILED DESCRIPTION OF THE PREFERRED EMBODIMENTS

Hangers are used for suspending a variety of clothing garments in order to preserve the finish and fresh appearance of garments, in particular to preserve the wrinkle free appearance of garments. The garment hanger of the present invention is for use in a garment treatment apparatus or, more generally, for supporting garments in an enclosure.

The present invention is particularly useful in either a solid-wall or alternatively a flexible or collapsible wall garment treatment apparatus (not shown), although the invention is not so limited. In such an apparatus, it is important to achieve a firm, even grip on a garment, so that treatment by fluid, air, steam, or some combination thereof, may be effected and a desired cleaning, refreshing or finishing result achieved. In addition, the present invention may be practiced in a garment hanger whose purpose is solely to store garments in a closet, wardrobe, shipping container or other enclosure.

Figure 1:
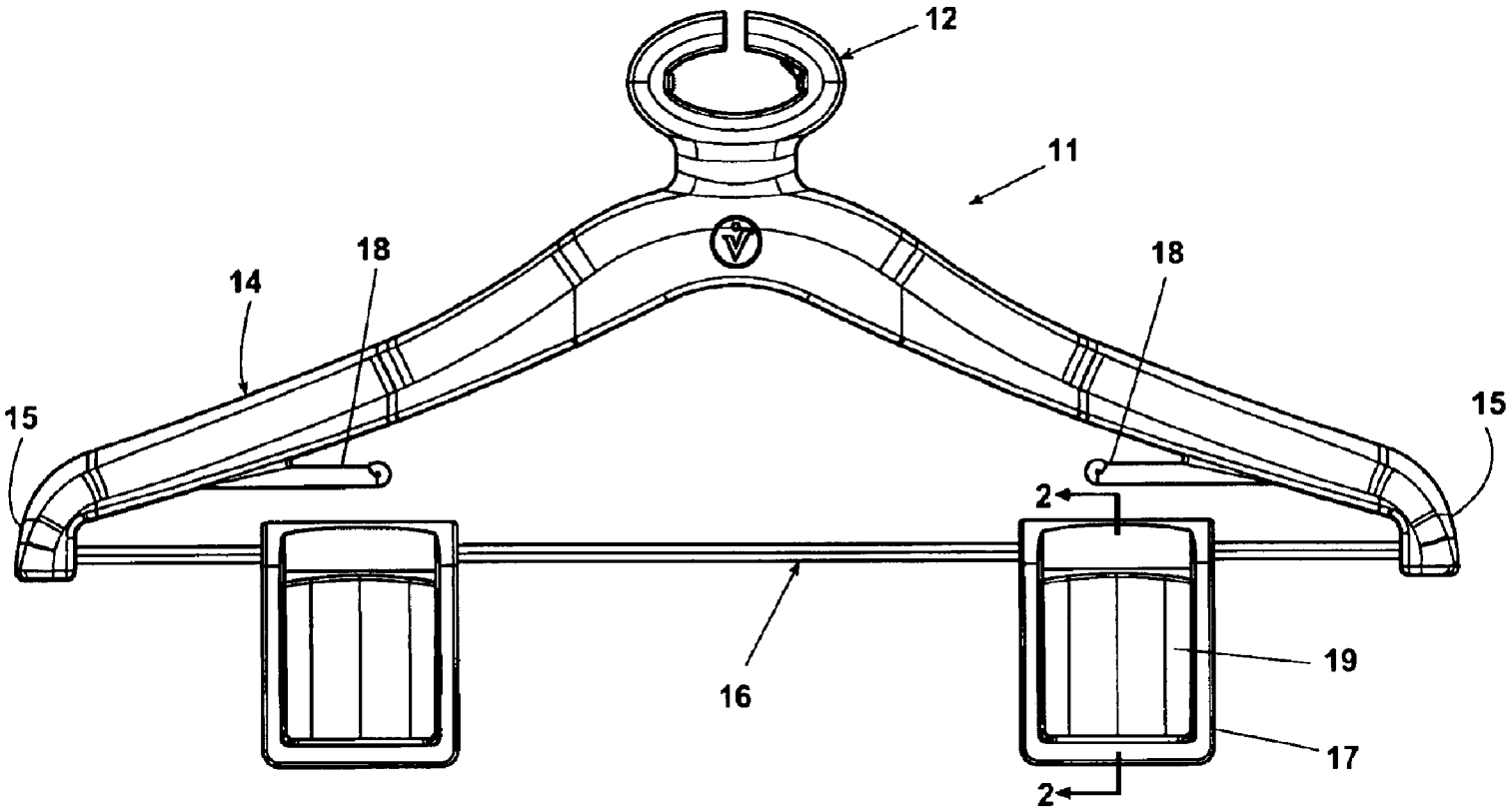
FIG. 1 is a front view of a hanger, in elevation.

An embodiment of the present invention disclosed in FIG. 1 is shown in front elevational view. As shown in FIG. 1, a garment hanger 11 includes a hook or ring 12 for suspending garment hanger 11 in a well-known conventional manner on a support, rod or other weight bearing member (not shown). It shall be clear to one of ordinary skill in the art that such hook or ring 12 may be of a c-shape, t-shape or o-shape or other appropriate shape to provide the desired function of securing the hanger 11 to a support or rod.

Garment hanger 11 includes an interior opening disposed therein, which may be dimensioned to securely fit a mating rod or support, such that garment hanger 11 may not rotate or swing on the rod or support. Extending outwardly and downwardly from the hook 12 is a bow 14 which may effectively be used to support a coat, jacket, blouse or shirt and in addition may provide support for the garment clamps as disclosed in the present invention. Bow 14 terminates in bow ends 15, and extending between bow ends is preferably disposed a rod 16 for supporting one or more garment clamps 17. Alternatively, garment clamps 17 may be suspended from fingers 18 or secured directly to bow 14.

Figure 2:
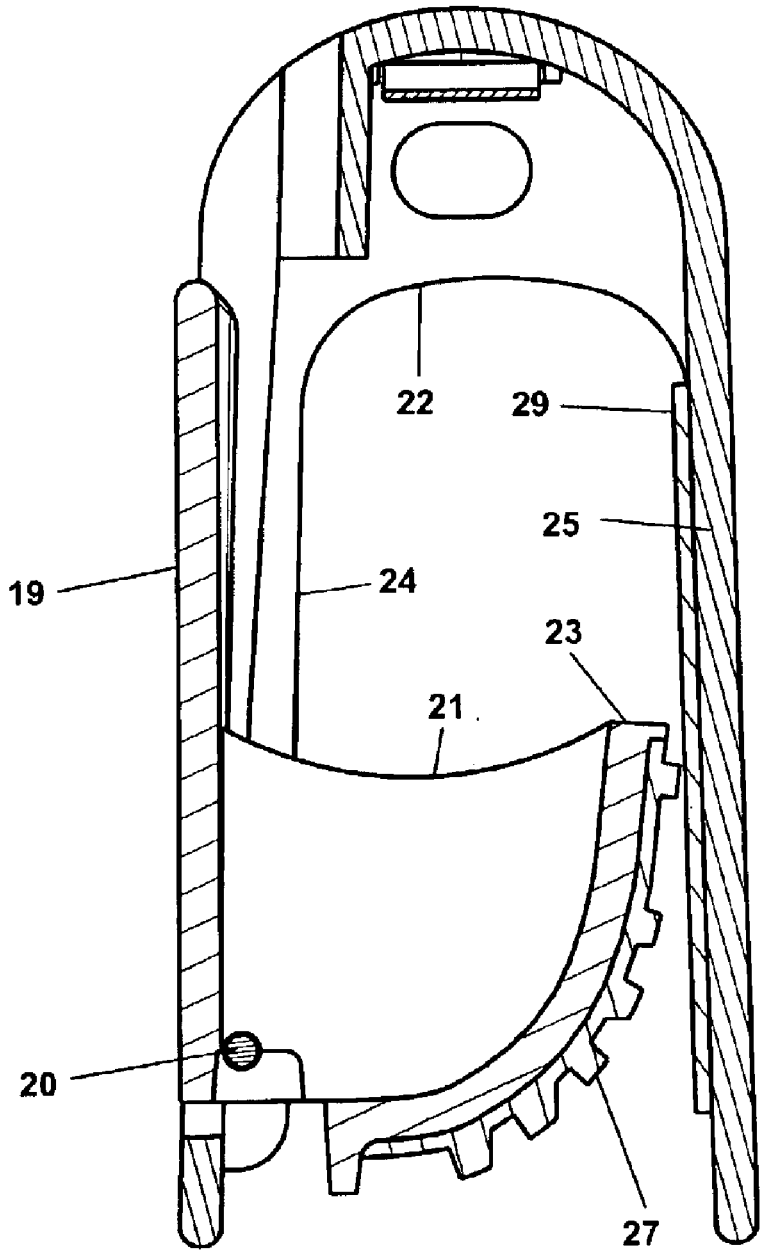
FIG. 2 is a section view of a hanger clamp taken along line II—II in FIG. 1.
Figure 3:
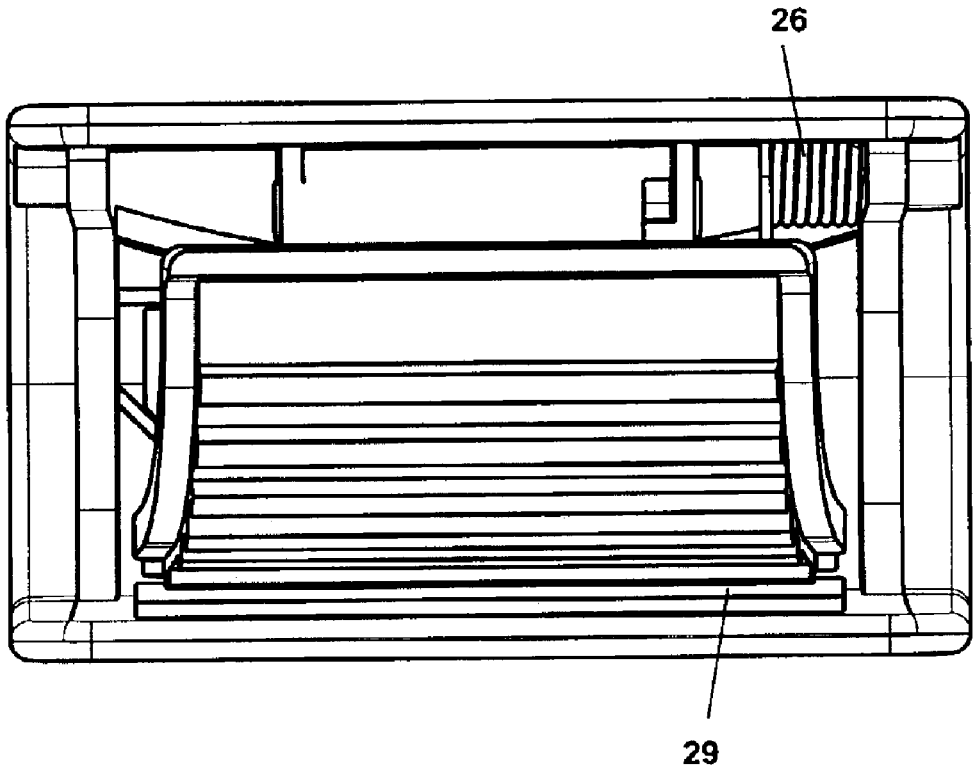
FIG. 3 is a bottom view of a hanger clamp.

The garment clamp of the present invention includes a release arm 19 for actuating the clamp. Release arm 19 is pivotable on pivot 20 in an outward and downward motion in order to effectively disengage the garment clamp from a garment. As shown in FIG. 2, pivot 20 is mounted on a first opposing interior wall 24 and provides an axis about which release arm 19 pivots. Cam 21 is pivotable within channel 22 in order to pivot gripping surface 23 in and out of engagement with a second opposing interior wall 25. Turning to FIG. 3, a pivot spring 26 may be provided to improve the pivot action, and particularly to provide improved return of release arm 19.

Figure 4:
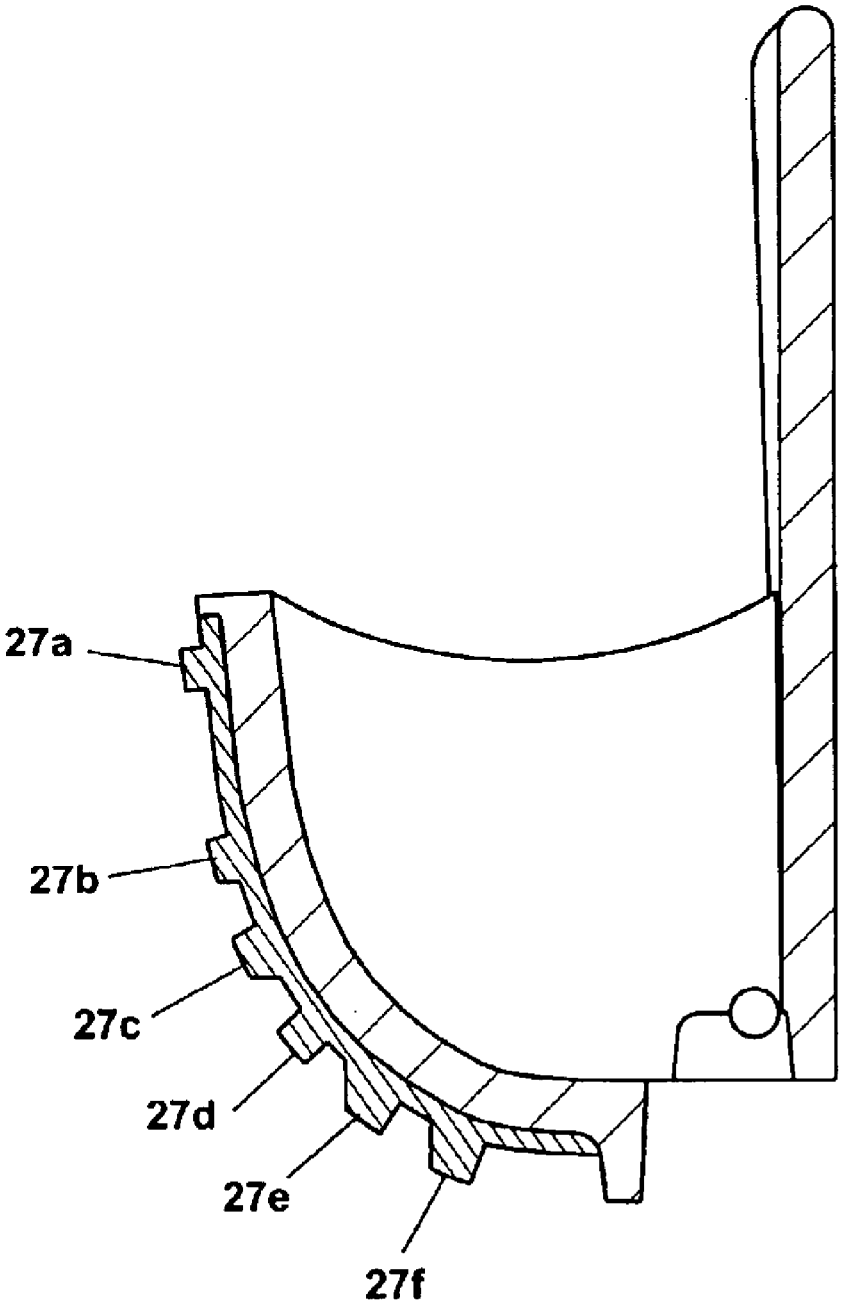
FIG. 4 is a side view of a hanger clamp, in elevation.

Gripping surface 23 of the present invention includes a plurality of gripping protrusions 27. Gripping surface 23 may be formed of an appropriate material for gripping fabric garments, an example of which may be a thermoplastic elastomer. An understanding of the operating conditions under which the garment clamp operates, including normal usage and expected variation has allowed development of a new arrangement of gripping protrusions 27 able to accommodate varying garment thicknesses, fabric types and loading variations. As shown in FIGS. 2–4, gripping protrusions 27 may extend laterally across a width of cam 21. Graduated or stepped engagement of garments is provided for by a specific arrangement of gripping ribs which vary over a range of height and distance from one another, in order to provide secure grip over a wide range of garment materials, weights and thicknesses.

As seen particularly in FIG. 4, gripping ribs 27*a–f* have squared edges for providing improved grip. A graduated arrangement of ribs each having increased height over the previous rib from rib 27*a* to 27*f* ensures that each rib will come into contact with the garment. As the garment drops and rotates the cam to bring the ribs into gripping engagement, the next rib is brought into position onto the garment. An incrementally decreasing spacing interval of ribs from rib 27*a* to 27*f* increases the positive grip on a garment, particularly in the event that a garment may be only partially disposed within the channel, or in the event that a garment be of sufficient thickness that the cam is prevented from rotating into a fully engaged position. Particularly in the latter event, it may be seen to be of importance to have increased overall gripping surface edge area in order to prevent a heavy garment from inadvertently slipping from the garment clamp 17. Therefore, a decreased spacing interval between the ribs may be seen to provide additional gripping squared surface edge areas in the area that cam 21 engages the garment.

When a thin garment is engaged within garment clamp 17, it readily enters channel 22, coming into contact with those ribs having the largest spacing interval, thereby permitting the garment to be secured within channel 22 while contacting as few ribs as possible, without an increased possibility of ribs leaving imprints or marks on the garment.

In order to improve the gripping performance of garment clamp 17, a friction pad 29 may optionally be added to second interior wall 25, made of such a material as appropriate for gripping fabric garments as is well known to one of ordinary skill, such as a thermoplastic elastomer. This surface may resemble the surface of coarse sandpaper. Once cam 21 is locked into position, the added friction pad 29 may serve to prevent the garment side facing friction pad 29 from sliding free. Friction pad 29 extends up into channel 22 at a point at or near the upper extent thereof, as shown in FIG. 2, and further extends widthwise the entire width of channel 22, as shown in FIG. 3, in order to provide additional garment gripping effect.

The present invention has been described utilizing particular embodiments. As will be evident to those skilled in the art, changes and modifications may be made to the disclosed embodiments and yet fall within the scope of the present invention. As one example, gripping ribs 27*a–f* may have a non-square edge, or alternatively a rounded garment gripping surface. The disclosed embodiments are provided only to illustrate aspects of the present invention and not in any way to limit the scope and coverage of the invention. The scope of the invention is therefore only to be limited by the appended claims.

What is claimed is:

1. In a garment hanger having a suspending hook and a bow having a pair of ends, a garment clamp comprising:

a garment receiving channel having a pair of opposed faces;

a garment gripping surface material disposed on one of said opposed faces; and a cam member hingedly disposed on the other of said opposed faces;

said cam member having a plurality of gripping surfaces for gripping a garment, wherein said plurality of gripping surfaces include a spaced series of raised ribs extending transversely on said cam member and having a varying height, said height varying from comparatively high to comparatively low progressively from the clamp exterior to the clamp interior.

2. A garment hanger according to claim 1, wherein said plurality of raised ribs have a varying spacing, said spacing varying from comparatively narrow to comparatively wide progressively from the clamp exterior to the clamp interior.

3. In a garment hanger having a suspending hook and a bow having a pair of ends, a garment clamp comprising:

a garment receiving channel having a pair of opposed faces;

a garment gripping surface material disposed on one of said opposed faces; and a cam member hingedly disposed on the other of said opposed faces;

said cam member having a plurality of gripping surfaces for gripping a garment, wherein said plurality of gripping surfaces include a spaced series of raised ribs having square edges.

4. A garment hanger according to claim 3, wherein said raised ribs are formed of a thermoplastic elastomer.

5. In a garment hanger having a suspending hook and a bow having a pair of ends, a garment clamp comprising:

a garment receiving channel having a pair of opposed faces;

a high friction garment gripping surface material disposed on one of said opposed faces; and a cam member hingedly disposed on the other of said opposed faces;

said cam member having a plurality of gripping surfaces for gripping a garment.

6. A garment hanger according to claim 5, wherein said high friction surface is a thermoplastic elastomer.

7. In a garment hanger having a suspending hook and a bow having a pair of ends, a garment support rod extending between said bow ends, at least one clamp mounted on said support rods for hanging a garment therefrom, said clamp comprising:

a garment receiving channel having a pair of opposed faces;

a high friction garment gripping surface material disposed on one of said opposed faces;

a cam member having a cam face and a release arm pivotally disposed on the other of said opposed faces;

said cam face having a plurality of gripping surfaces for gripping a garment, and being pivotable by said release arm in and out of garment gripping engagement against said high friction garment gripping surface material.

8. A garment hanger according to claim 7, wherein said release handle is spring loaded with a pivot spring.

9. A garment hanger according to claim 7, wherein said gripping surfaces are raised ribs.

10. A garment hanger according to claim 9, wherein said raised ribs have square edges.

11. A garment hanger comprising:

a suspending book;

a bow centrally mounted on and extending from said suspending hook and having a pair of ends;

a garment support rod extending between said bow ends;

a clamp mounted on said support rod at each of said bow ends for hanging a garment therefrom, each of said clamps including;

a garment receiving channel having a pair of opposed faces;

a high friction garment gripping surface material disposed on one of said opposed faces;

a cam member having a cam face and a release arm pivotally disposed on the other of said opposed faces, said cam face having a plurality of gripping surfaces for gripping a garment, and being pivotable by said release arm in and out of garment gripping engagement against said high friction garment gripping surface material.

12. A garment hanger according to claim 11, wherein said gripping surfaces are raised ribs having square gripping edges.

* * * * *